US011716568B2

(12) United States Patent
Ali

(10) Patent No.: US 11,716,568 B2
(45) Date of Patent: Aug. 1, 2023

(54) MODULAR SPEAKERS

(71) Applicant: HARMAN INTERNATIONAL INDUSTRIES, INCORPORATED, Stamford, CT (US)

(72) Inventor: Hussnain Ali, Frisco, TX (US)

(73) Assignee: Harman International Industries, Incorporated, Stamford, CT (US)

( * ) Notice: Subject to any disclaimer, the term of this patent is extended or adjusted under 35 U.S.C. 154(b) by 99 days.

(21) Appl. No.: 17/228,575

(22) Filed: Apr. 12, 2021

(65) Prior Publication Data

US 2021/0321194 A1 Oct. 14, 2021

Related U.S. Application Data

(60) Provisional application No. 63/009,062, filed on Apr. 13, 2020.

(51) Int. Cl.
*H04R 3/14* (2006.01)
*H04R 5/04* (2006.01)

(52) U.S. Cl.
CPC ..... *H04R 3/14* (2013.01); *H04R 5/04* (2013.01); *H04R 2420/07* (2013.01)

(58) Field of Classification Search
CPC .. G06F 3/162; H04R 5/02; H04R 3/12; H04R 2227/005; H04R 2205/024; H04S 7/30; H04S 7/302
USPC ..... 381/300, 310; 700/94
See application file for complete search history.

(56) References Cited

U.S. PATENT DOCUMENTS

| | | | | |
|---|---|---|---|---|
| 9,866,447 | B2 * | 1/2018 | Millington | H04L 12/2807 |
| 11,013,987 | B1 * | 5/2021 | Pelissier | A63F 13/92 |
| 2010/0177909 | A1 | 7/2010 | Aarts et al. | |
| 2013/0089226 | A1 * | 4/2013 | Burleigh | H04R 25/658 381/312 |
| 2015/0237424 | A1 | 8/2015 | Wilker et al. | |
| 2018/0192196 | A1 | 7/2018 | Gunnarsson | |
| 2018/0348524 | A1 * | 12/2018 | Blum | G02B 27/0176 |
| 2020/0053462 | A1 * | 2/2020 | Qian | H04R 1/026 |
| 2020/0367009 | A1 * | 11/2020 | Family | H04S 7/305 |
| 2021/0321194 | A1 * | 10/2021 | Ali | H04R 5/04 |

FOREIGN PATENT DOCUMENTS

EP 2860992 B1 12/2018

* cited by examiner

*Primary Examiner* — Alexander Krzystan
(74) *Attorney, Agent, or Firm* — Artegis Law Group, LLP

(57) ABSTRACT

Embodiments of the present disclosure set forth a system that includes an audio system module. The audio system module includes a speaker, a connector, and one or more processing units. The one or more processing units are configured to detect a second audio system module connected to the connector; determine a network map of audio system modules, wherein the network map comprises at least the first audio system module and the second audio system module; determine a mode of operation based on the network map; receive an audio signal; and via the speaker, output audio corresponding to the audio signal based on the mode of operation.

20 Claims, 9 Drawing Sheets

MODULAR SPEAKERS

CROSS-REFERENCE TO RELATED APPLICATION

This application claims the benefit of U.S. Provisional Application No. 63/009,062, titled "MODULAR SPEAKERS," filed on Apr. 13, 2020, the subject matter of which is incorporated by reference herein in its entirety.

BACKGROUND

Field of the Various Embodiments

The various embodiments relate generally to audio systems, and more specifically, to modular speakers.

Description of the Related Art

A key component for the enjoyment of audio content is speakers, which are responsible for converting electrical audio signals into sounds. With the mass proliferation of audio-only and audio-containing content via a variety of devices, demand for speakers has greatly increased. For example, a user may have a demand for speakers in the home, in the vehicle, in the workplace, and on the go.

Multiple types of conventional speaker systems are available for various situations. One type of speaker system, typically intended for fixed or stationary installations such as for home use, includes multiple speakers, and each of these speakers is connected to a specific channel, often by a physical wire. The speakers within this type of speaker system are often configured for specific functionality within the speaker system. Another type of speaker system includes one speaker unit, often portable, that can be coupled to an audio source but not to other speakers.

A drawback of these conventional speaker systems is the limited configurability and functionality of such speaker systems. For example, fixed-installation speakers are typically large and are difficult to move and/or position, and thus are typically limited to uses where those speakers are expected to remain in place indefinitely. Additionally, specific-functionality or specific-channel speakers cannot be easily repurposed for other uses (e.g., a rear-channel speaker not used in a 5.1-channel speaker system cannot be easily deployed for single-speaker or 2.1-channel systems. Meanwhile, smaller, more portable speakers are often, for the sake of making the speaker portable, limited in connectivity options, audio processing capabilities, and/or audio output capabilities. The limited configurability and functionality of conventional speakers force the user to get multiple different speakers for different use cases, thus increasing the expense for enjoyable audio experiences across multiple use cases.

What is needed are speaker systems with broader configurability and functionality.

SUMMARY

One embodiment sets forth a method for outputting audio at an audio system module comprising detecting a second audio system module connected to the audio system module via a physical connection; determining a network map of audio system modules, wherein the network map comprises at least the audio system module and the second audio system module; determining a mode of operation based on the network map; receiving an audio signal; and outputting audio corresponding to the audio signal based on the mode of operation.

Another embodiment sets forth a method for outputting audio at an audio system module comprising receiving a test signal; in response to the test signal, outputting a response signal; receiving network map information indicating a network map of audio system modules, wherein the network map is determined based on at least the response signal; determining a mode of operation based on the network map; receiving an audio signal; and outputting audio corresponding to the audio signal based on the mode of operation.

Further embodiments provide, among other things, one or more computer-readable storage media and a system configured to implement any of the methods set forth above.

An advantage and technical improvement of the disclosed embodiments relative to the prior art is that an audio system module is portable and can be flexibly arranged and combined in conjunction with additional audio system modules. Accordingly, an audio system composed of such modules can be deployed and configured physically and acoustically for different use cases. Such an audio system can also be easily positioned and scaled to various form factors, sizes, and functionalities and/or capabilities based on the use case. Such an audio system can also be easily repositioned and/or reconfigured compared to conventional speaker systems. Furthermore, a set of audio system modules can be physically connected into a network of modules and self-map the network of modules. The capability of a module within the network can be controlled according to its location within the network. These technical advantages provide one or more technological improvements over prior art approaches.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, it will be apparent to one of skilled in the art that the inventive concepts may be practiced without one or more of these specific details.

Figure 1:
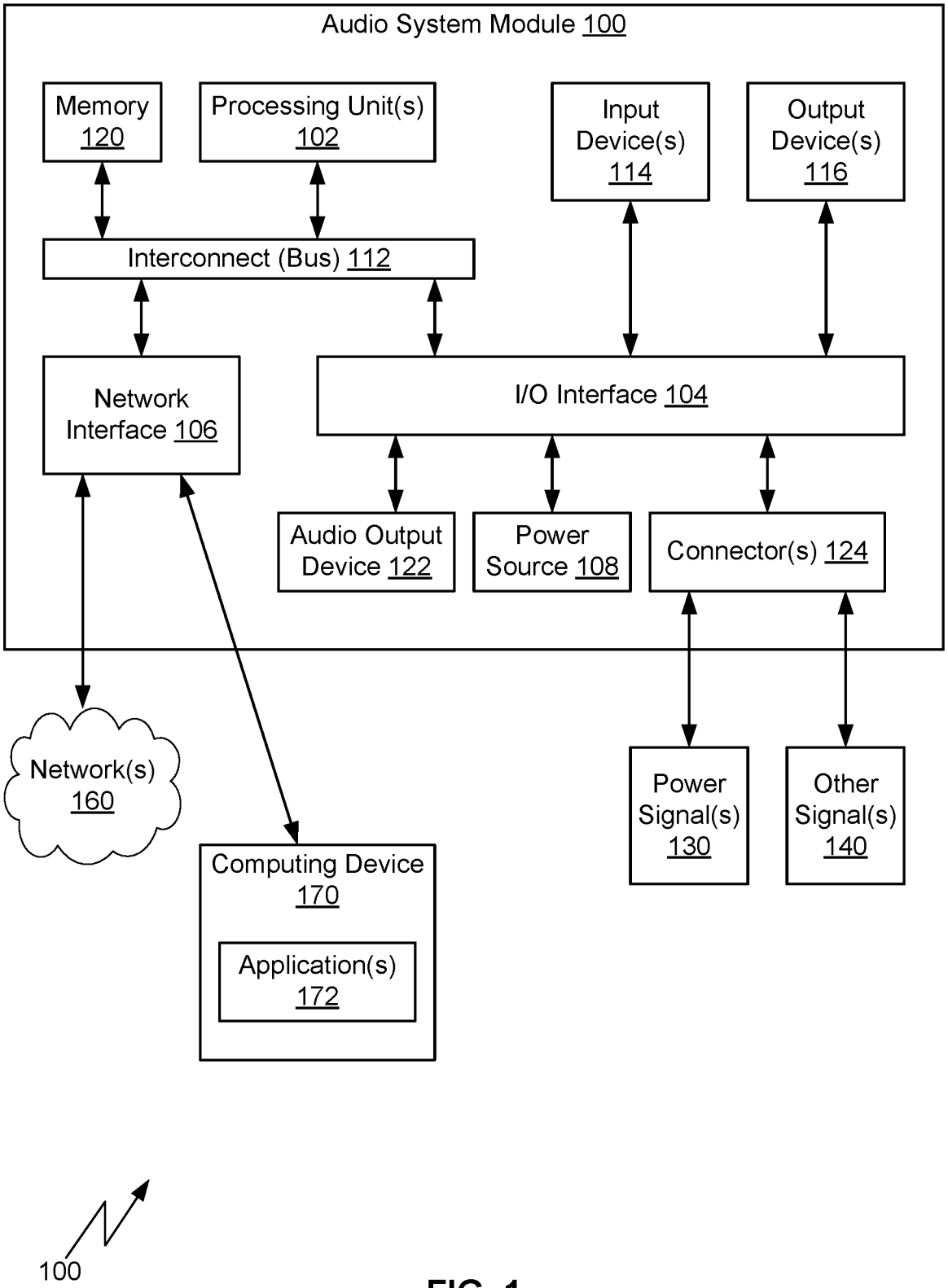
FIG. 1 illustrates a block diagram of an audio system module, according to various embodiments.

FIG. 1 illustrates a block diagram of an audio system module 100 configured to implement one or more aspects of the various embodiments. In various embodiments, audio system module 100, which can also be called a "cell," can be coupled physically and/or wirelessly with, and operate in conjunction with, one or more additional audio system modules 100. As shown, audio system module 100 includes, without limitation, one or more processing units 102, I/O device interface 104, network interface 106, interconnect (bus) 112, and memory 120. Processing unit(s) 102, I/O device interface 104, network interface 106, and memory 120 can be communicatively coupled to each other via interconnect 112.

Processing unit(s) 102 may include a central processing unit (CPU), a digital signal processing unit (DSP), a microprocessor, an application-specific integrated circuit (ASIC), a neural processing unit (NPU), a graphics processing unit (GPU), a field-programmable gate array (FPGA), and/or the like. Each processing unit 102 generally comprises a programmable processor that executes program instructions to manipulate input data. In some embodiments, processing unit(s) 102 may include any number of processing cores, memories, and other modules for facilitating program execution. In various embodiments, processing unit(s) 102 further include any number of audio processing circuits, processors, modules, and/or the like for processing audio signals. Examples of audio processing circuits and/or the like include, without limitation, digital-to-analog converter, digital signal buffer, amplifier, beam-forming circuitry, and so forth. In some embodiments, processing unit(s) 102 include a low-power DSP unit.

Memory 120 can include a memory module or collection of memory modules. Memory 120 generally comprises storage chips such as random access memory (RANI) chips that store application programs and data for processing by processing unit(s) 102. Processing unit(s) 102, I/O device interface 104, and network interface 106 can be configured to read data from and write data to memory 120. In various embodiments, audio system module 100 can further include non-volatile storage (not shown). The non-volatile storage can include storage for applications, software modules, and data, and can include flash memory devices, read-only memory (ROM), or other solid state storage devices, and/or the like. The non-volatile storage can include sets of instructions (e.g., applications) that, when executed, configure processing units(s) 102 to perform any of the operations and techniques described herein.

In some embodiments, audio system module 100 can communicatively couple with one or more networks 160. Network(s) 160 may be any technically feasible type of communications network that allows data to be exchanged between audio system module 100 and remote systems or devices, such as a server, a cloud computing system, or other networked computing device or system. For example, network 160 could include a local area network (LAN), a wireless network (e.g., a Wi-Fi network), and/or the Internet, among others. Audio system module 100 can connect with network(s) 160 via network interface 106. In some embodiments, network interface 106 is hardware, software, or a combination of hardware and software, that is configured to connect to and interface with network(s) 160.

In some embodiments, audio system module 100 can communicatively couple with a local computing device 170 separate from audio system module 100 and other audio system modules coupled to audio system module 100. For example, audio system module 100 could be paired with computing device 170 (e.g., a smartphone, a tablet computer, a notebook or desktop computer) associated with the user. One or more applications 172 executing on the paired computing device 170 can operate in conjunction with audio system module 100 to, for example, configure audio system module 100 and/or output audio signals to audio system module 100. Audio system module 100 can be coupled to computing device 170 via network interface 106 (e.g., via network(s) 160) and/or via I/O device interface 104 by wire or wireless in any technically feasible manner (e.g., Universal Serial Bus (USB), Bluetooth, Wi-Fi).

Audio system module 100 can include one or more input devices 114. Input devices(s) 114 can include devices capable of receiving input. Examples of input device(s) 114 include, without limitation, a touch-sensitive surface (e.g., a touchpad), a touch-sensitive screen or display, one or more microphones, buttons, knobs, dials, and/or the like. In some embodiments, the microphone(s) are configured to receive sounds from the environment (e.g., voice input from a user, test signals from computing device 170). The microphone(s) may include, without limitation, unidirectional microphones, omnidirectional microphones, directional microphones, a microphone array, beam-forming microphones, microelectro-mechanical (MEMS) microphones, and/or the like.

Audio system module 100 can include one or more output devices 116. Output device(s) 116 can include devices capable of providing output. Examples of output device(s) 116 include, without limitation, a display device. Examples of display devices include, without limitation, LCD displays, LED displays, touch-sensitive displays, LED lights (e.g., indicator lights) and/or the like. Audio system module 110 can also include devices capable of both receiving input and providing output, such as a touch-sensitive display, and/or the like.

Audio system module 100 can include an audio output device 122. Audio output device 122 include a device capable of outputting sound to the user. In some embodiments, audio output device 122 includes a transducer (e.g., speaker) configured to convert electrical audio signals to audible sounds. In some embodiments, audio output device 122 is capable of outputting the full range of human-audible frequencies (and optionally also one or more human-inaudible frequency ranges) and can be configured to output sounds in the full human-audible range or a subset of the human-audible frequency range. For example, audio output device 122 could be configured to be a full-range speaker, a subwoofer, a tweeter, or the like.

Audio system module 100 can include a power source 108. Power source 108 supplies electrical power to audio system module 100. Power source 108 can include, without limitation, a battery internal to audio system module 100, a power supply configured to receive electrical power from a power source external to audio system module 100 (e.g., an external battery, a wall power socket, another physically connected audio system module 100), and/or the like. In some embodiments, power source 108 also includes circuitry configured to process power signals (e.g., power signals 130) and manage the power consumption of audio system module 100. For example, the circuitry can include circuits that respectively perform voltage conversion, perform AC-to-DC conversion, regulate the supply and delivery of power to certain components of audio system module 100 and/or to other physically connected audio system modules, regulate battery charging, put audio system module 100 into a sleep mode, and/or the like.

Audio system module 100 includes one or more connectors 124. Connector(s) 124 facilitate physical connection to other audio system modules 100 and also input/output (e.g., signal transmission) between the physically connected audio system modules. Via connector(s) 124, audio system module 100 can be connected to one or more other audio system modules and transmit and/or receive power signals 130 (e.g., electrical power) and/or other signals 140 (e.g., audio signals, control signals, data signals, other data or information) to/from those connected audio system module(s). In some embodiments, connectors 124 include magnetic connectors that can magnetically couple to similar connectors on another audio system module. These magnetic connectors are also electrically conductive, and accordingly signals (e.g., power signals 130 and/or other signals 140) can propagate through the magnetically coupled connectors. These connectors 124 can be exposed on one or more outer surfaces of audio system module 100. These connectors 124 are configured to be magnetically and/or electrically coupled to similar connectors 124 on another audio system module 100.

In some embodiments, connectors 124 also includes one or more other physical connectors, in addition to the connectors for connecting to other audio system modules. For example, connectors 124 can include a USB receptacle for connecting to an external power source and/or to computing device 170 via a USB cable, an input source connector (e.g., a 3.5 mm audio jack socket, a line-in connector) for connecting to an audio source, a power connector for connecting to a power plug that can plug into a wall power socket, and/or the like.

In some embodiments, multiple types of audio system modules 100 are implemented as a family of audio system modules than can be coupled and operate together, and one or more of the above-described components may be configured differently and/or omitted depending on the type of module and a role associated with the type. For example, a family of audio system modules could include a full-range speaker module, a subwoofer module, a display module, an audio source module, a control module, a power module, and a wireless connection module. A full-range speaker would include an audio output device 122 configured for full-range output and may omit input devices 114 and output devices 116. A subwoofer module is similar to the full-range speaker except that the audio output device 122 of the subwoofer module would be configured for outputting a low-frequency range (e.g., bass). A display module could omit audio output device 122 and would include a display amongst output devices 116; the display module could display various information, such as information about the audio content being played, sound settings (e.g., equalizer settings), visualizations of the audio being played, etc. An audio source module could omit audio output device 122 and would include various source input connectors and options (e.g., Bluetooth, Wi-Fi, HDMI, 3.5 mm audio jack, line-in connector, other analog audio connectors). A control module could omit audio output device 122 and would include input device(s) 114 that can receive input from a user (e.g., knob(s), touchscreen, button(s)). A power module could omit audio output device 122 and would include a power source 108 that can draw power (e.g., power signals 130) from a source (e.g., battery, wall power socket) and process the power signals (e.g., AC-to-DC conversion, regulate power delivery to components and/or to other modules, etc.). A wireless connection module could omit audio output device 122 and would include instructions and/or applications that enable receipt routing of signals 140 (e.g., audio signals, control signals) to other audio system modules within the audio system; the wireless connection module can serve as a coordinator or mediator between a device providing signals 140 (e.g., computing device 170) and other audio system modules within the audio system. A number of modules in this family can connect together physically and/or wirelessly to form an audio system. In some other embodiments, each type of audio system module in the family of modules can be configured for respective ones of the multiple roles described above and still include an audio output device 122 (and thus can still operate as a speaker).

In some embodiments, one or more of the above-described components of audio system module 100 may be located in a module shell that is separate from audio system module 100 and has a cavity that can house the audio system module. For example, the module shell can include one or more processing units, memory, storage, a power source (e.g., battery), a network interface, wireless transmission capability, source input connectors, I/O interface, input devices, and/or output devices. The module shell has one or more connectors (e.g., magnetic connectors), exposed on the inside walls of the cavity, that match with and can connect to externally-exposed connectors 124 (e.g., magnetic connectors) of an audio system module 100 housed in the cavity. The module shell enables an audio system module 100 housed in the cavity to operate without a direct physical connection to other audio system modules (e.g., as a single portable speaker, as a single speaker operating in conjunction with other wirelessly communicatively coupled audio system modules). The module shell is further described below in conjunction with FIG. 4.

In various embodiments, audio system module 100 is a unit that can be physically connected and/or be communicatively coupled (e.g., wirelessly) to one or more other additional audio system modules 100. A single audio system module 100, or a set of physically connected and/or communicatively coupled audio system modules 100, can be communicatively coupled to an audio source (e.g., computing device 170, an audio source connected via a line-in connector 124). Further, a set of physically connected and/or communicatively coupled audio system modules 100 can communicate with each other and identify their locations relative to each other and/or their respective functions. Output of audio signals by the set of physically connected and/or communicatively coupled audio system modules 100 can be controlled based the locations and/or functions of respective audio system modules 100 within the set.

In various embodiments, audio system module 100 has a form factor that enables audio system module 100 to be easily moved, positioned, and/or connected to other audio system modules 100. For example, in some embodiments, audio system module 100 could be approximately the size of the palm of an adult hand. Audio system module 100 can be placed on a surface in any technically feasible manner (e.g., placed on a horizontal surface; mounted on a vertical surface via adhesive, magnet, mounting bracket, hole that hooks onto a nail or screw, and/or the like).

As described above, two or more audio system modules 100 can be physically connected via connectors 124 (e.g., magnetic connectors) on each of the two or more audio system modules 100. The two or more audio system modules 100 physically connect to form a planar arrangement (e.g., a planar array) of audio system modules 100. The form factor of audio system module 100 can be designed to facilitate physical connection into a planar arrangement. In some embodiments, form factor of audio system module 100 has a right prism geometry, where the front and rear face or base of the geometry are n-sided polygons of the same shape, and the side faces or walls are rectangles joining corresponding sides of the front and rear faces. The n-sided polygon of the front/rear face can be, for example, a triangle (e.g., equilateral triangle), a square, a hexagon, or the like. Connectors 124 are exposed on the side walls, and audio system modules 100 can physically connect via the connectors on the side walls.

Figure 2A:
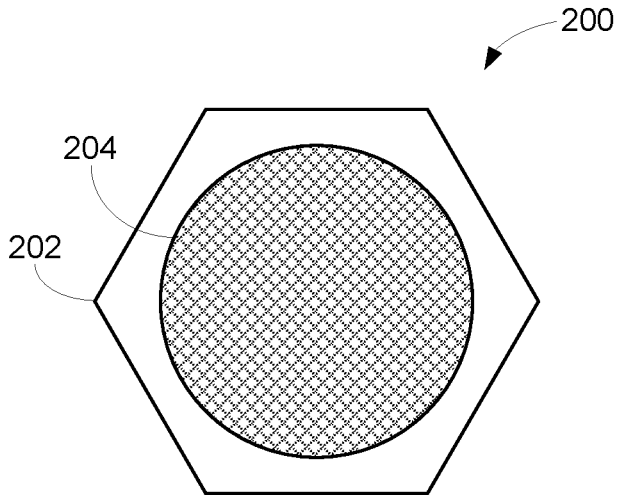
FIGS. 2A-2B illustrate different views of an audio system module, according to various embodiments.
Figure 2B:
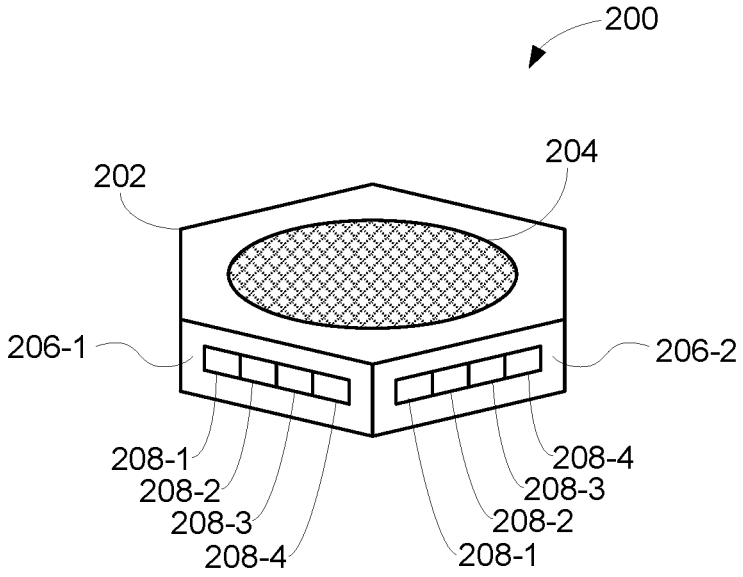

FIGS. 2A-2B illustrate different views of an audio system module, according to various embodiments. FIG. 2A illustrates a front plan view of an audio system module 200, and FIG. 2B illustrates a perspective view of the audio system module 200. As shown in FIG. 2A, audio system module 200 (e.g., one audio system module 100) has a housing 202, of which the front face is shown in FIG. 2A. Housing 202 houses the components of audio system module 200 (e.g., components described with respect to FIG. 1 above). As shown in FIGS. 2A-2B, audio system module 200 has a prism geometry, with both a front face and a rear face (not shown) having a hexagonal shape.

Housing 202 has a number of side walls 206 matching the number of sides of the shape of the front/rear face. Accordingly, housing 202 as shown has six side walls, of which two side walls 206-1 and 206-2 are shown.

Audio system module 200 as shown includes a speaker 204 (e.g., audio output device 122). On the front face of housing 202 as shown in FIG. 2A, speaker 204 is exposed (e.g., a diaphragm and/or a speaker grille of speaker 204 is exposed). For an audio system module 200 that omits audio output device 122, another component can be exposed on the front face of housing 202 in place of speaker 204. For example, a display device (of output devices 116) and/or one or more input devices 114 can be exposed on the front face in place of speaker 204.

Audio system module 200 also has a rear face (not shown) opposite of the front face shown in FIG. 2A. The rear face can include any number of features that enable the module to be mounted on a surface (e.g., a wall). The rear face can include, for example, an adhesive pad, a magnetic pad, or a hole configured to hook onto a nail or screw on a wall.

Side walls 206 includes and exposes connectors 208 (e.g., connectors 124). As shown, each side wall 206 includes four connectors 208. Each of these connectors 208 are magnetic and electrically conductive, and can magnetically and/or electrically couple to a set of four similar connectors 208 on a side wall of another audio system module 200.

In some embodiments, each connector of a set of four connectors 208 on a side wall carries certain signals. For example, connectors 208-1 and 208-4 can carry power signals 130 and connectors 208-2 and 208-3 can carry other signals 140, such as data or audio signals. Accordingly, two audio system modules 200 physically coupled to each other can exchange power signals via connectors 208-1 and/or 208-4, and exchange other signals 140 via connectors 208-2 and/or 208-3.

FIGS. 3A-3D illustrate example arrays of physically connected audio system modules, according to various embodiments. As described above, two or more audio system modules (e.g., audio system modules 100 or 200) can be physically connected into a planar, tiled arrangement via the connectors (e.g., connectors 208) exposed on the side walls (e.g., side walls 206), with the front faces of the connected audio system modules facing the same direction.

Figure 3A:
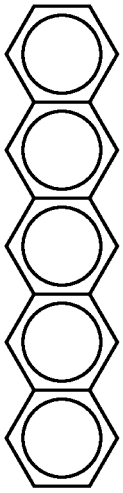
FIGS. 3A-3D illustrate example arrays of physically connected audio system modules, according to various embodiments.
Figure 3B:
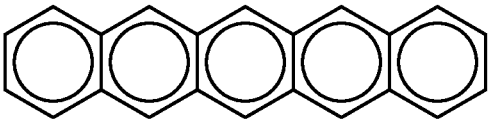

FIGS. 3A-3B illustrate linear arrangements of multiple audio system modules physically connected via their side walls. FIG. 3A illustrates a linear arrangement oriented vertically, and FIG. 3B illustrates a linear arrangement oriented horizontally. The vertically oriented arrangement shown in FIG. 3A can be deployed similarly as a speaker tower, and the horizontally oriented arrangement can be deployed similarly as a sound bar.

Figure 3C:
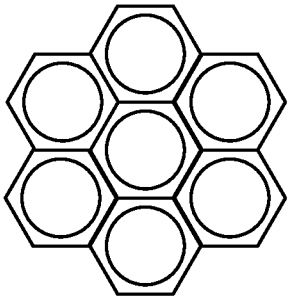
Figure 3D:
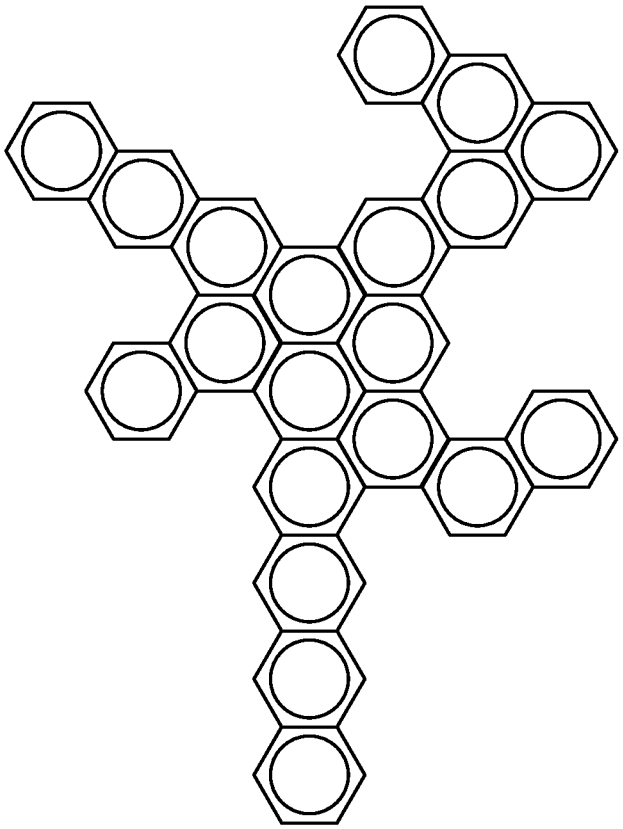

FIG. 3C illustrates a symmetric arrangement of multiple audio system modules physically connected via their side walls. As shown, the audio system modules are connected into a symmetric array resembling a honeycomb. FIG. 3D illustrates an arbitrary arrangement of multiple audio system modules physically connected via their connectors.

While FIGS. 3A-3D illustrate arrangements of specific numbers of connected audio system modules, it should be appreciated that any number of audio system modules can be physically connected via their connectors (e.g., connectors 124, 208) to form any array or other planar arrangement feasible for the geometries of the audio system modules.

Figure 4:
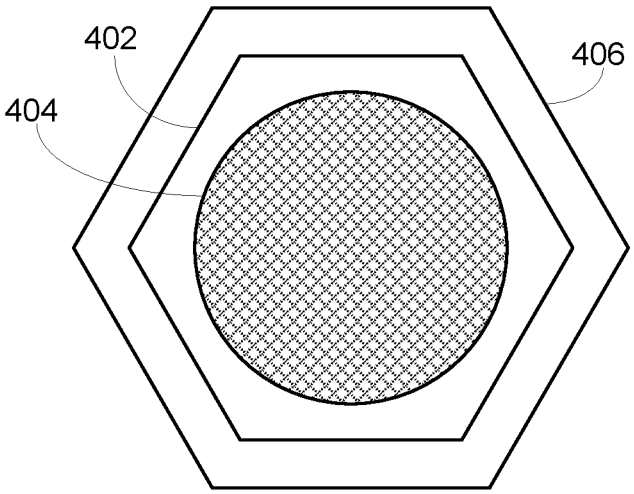
FIG. 4 illustrates an audio system module held in a module shell, according to various embodiments.

FIG. 4 illustrates an audio system module held in a module shell, according to various embodiments. As described above, a module shell can be separate from, and house, an audio system module 100. FIG. 4 illustrates a front plan view of an audio system module housed in a cavity of the module shell. As shown, an audio system module with housing 402 and speaker 404 is housed in a module shell 406. The front face of the audio system module is exposed; module shell 406 can enclose the sides and rear face of the audio system module while exposing the front face of the audio system module. Module shell 406 can receive housing 402 in a cavity having a geometry that matches the geometry of housing 402 (e.g., a hexagonal cavity for a hexagonal housing 402). The side walls of the cavity of module shell 406 include connectors (not shown) that physically connect (e.g., magnetically and/or electrically connect) to the connectors (e.g., connectors 208) on the side walls of the audio system module, similar to how connectors 208 on two audio connector modules can connect to each other. These connectors of module shell 406 communicatively couple the audio system module to the internal components (e.g., I/O interface, processing units, network interface, etc.) of module shell 406. Module shell 406 can have a prism geometry, similar to the audio system module. The rear face of module shell 406, opposite of the front face of module shell 406, can have features that enable mounting on a surface (e.g., adhesive pad, magnetic pad, hole configured to hook onto a nail or screw on a wall).

While FIG. 4 shows a module shell 406 that has a similar outer geometry as housing 402 of the audio system module, in some embodiments module shell 406 can have an overall geometry different from housing 402 while the cavity for receiving housing 402 still has a geometry that matches the geometry of housing 402. For example, module shell 406 can have a rectangular prism or cylinder geometry (e.g., so the front face of module shell 406 would be a rectangle (e.g., square) or circle, respectively, instead of the hexagon as shown in FIG. 4), while still having a hexagonal cavity for receiving a hexagonal audio system module.

Figure 5:
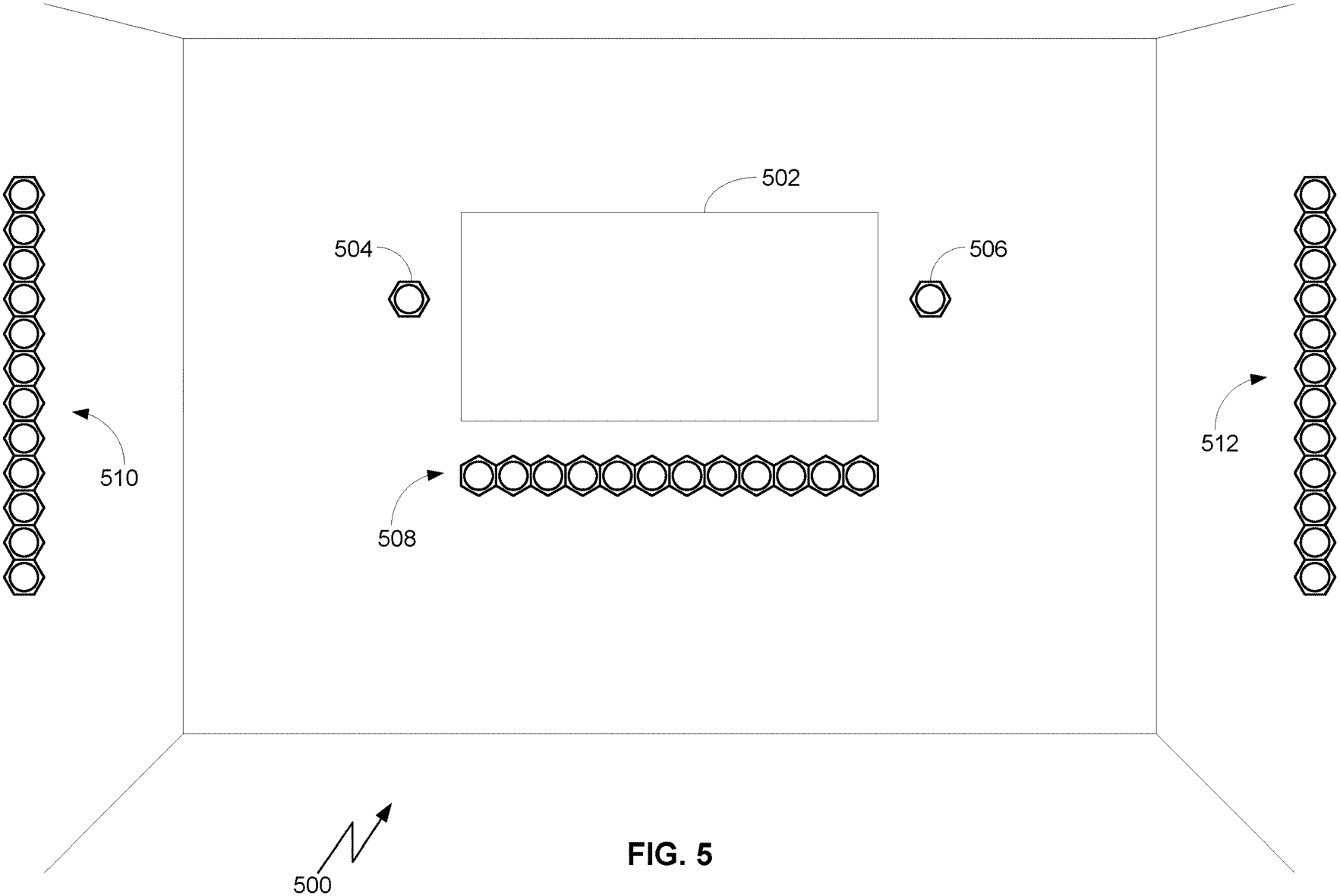
FIG. 5 illustrates an example distribution of audio system modules in a space, according to various embodiments.

FIG. 5 illustrates an example distribution of audio system modules in a space, according to various embodiments. Two or more audio system modules forming an audio system can be distributed across a space (e.g., a room) in any feasible arrangement. For example, as shown, audio system modules 504 and 506 can be positioned adjacent to a wall-mounted television 502 in a space 500, on either side of television 502. A set 508 of physically connected audio system modules (e.g., a horizontally oriented linear array) can be positioned below television 502. Another set 510 of physically connected audio system modules (e.g., a vertically oriented linear array) can be placed on one side of space 500, and a further set 512 of physically connected audio system modules (e.g., a vertically oriented linear array) can be placed the opposite side of space 500.

Figure 6:
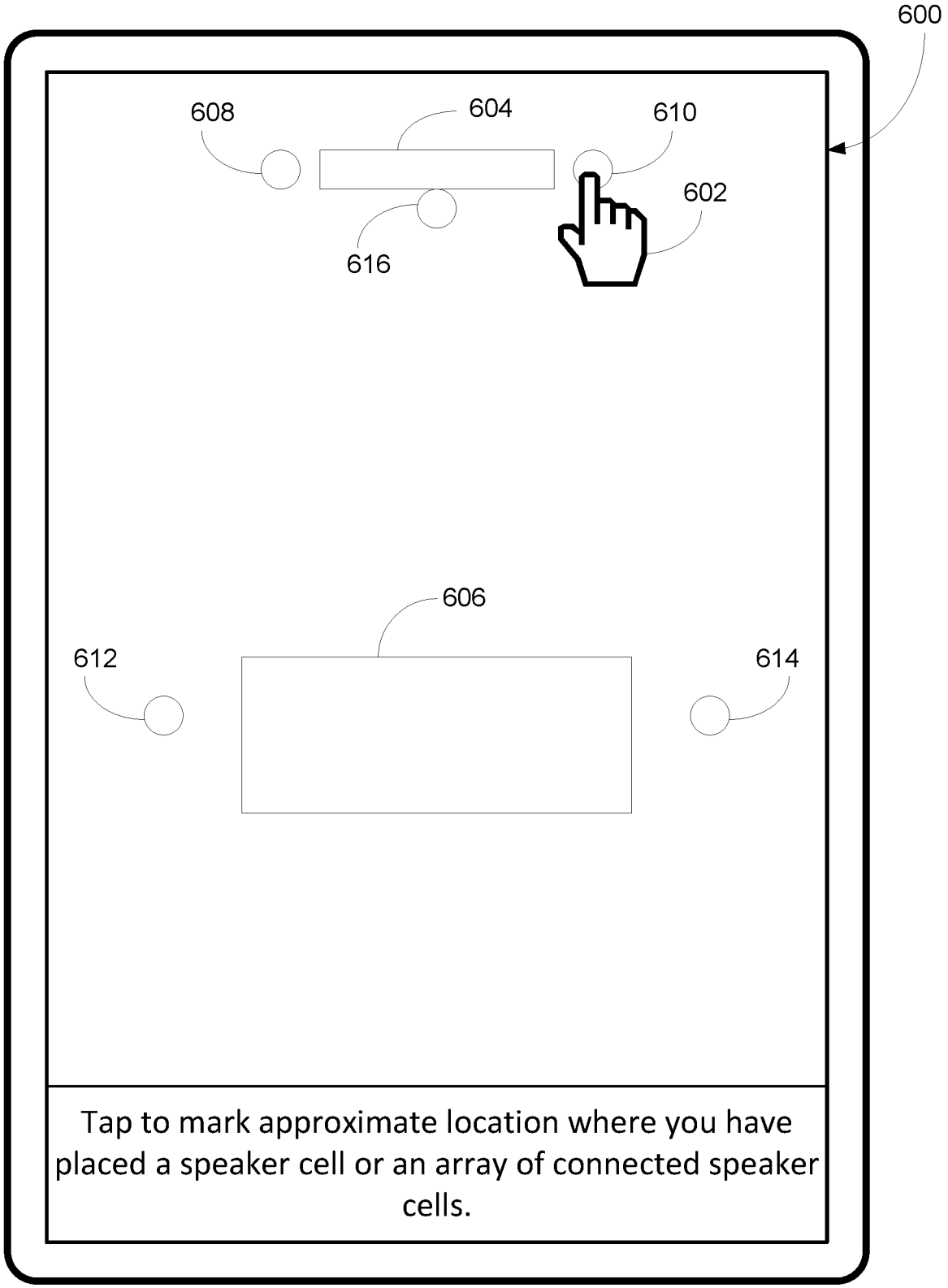
FIG. 6 illustrates an example user interface for specifying a distribution layout of audio system modules in a space, according to various embodiments.

FIG. 6 illustrates an example user interface for specifying a distribution layout of audio system modules in a space, according to various embodiments. In some embodiments, a distribution of the audio system modules can be input into an external device (e.g., computing device 170) by a user via an application executing on the external device. FIG. 6 shows an example user interface of such an application. As shown, user interface 600 is a touch-based interface displayed on a touch-sensitive display of an external device. A user can use touch-based controls (e.g., gestures, etc.) to specify locations audio system modules and notable pieces of furniture or equipment in a floor plan view of a space. For example, as shown, a television 604 and a couch 606 has been marked in the floor plan view. The user can tap on user interface 600 with finger 602 to mark locations of audio system modules in the floor plan view. As shown, locations 608, 610, 612, 614, and 616 are marked as locations of audio system modules. Locations 608 and 610 are on either side of television 604, locations 612 and 614 are on either side of couch 606, and location 616 is in front of television 604.

While FIG. 6 shows the application providing a floor plan view in user interface 600 for marking locations of audio system modules, the application can also provide other views of the space, including for example a view from inside the space. Further in some embodiments, if the external device is equipped with an image capture device (e.g., a camera), an application executing on the external device could capture one or more images of the space and display the image(s) in user interface 600, where the user can mark locations of audio system modules on the displayed image(s) (e.g., via an augmented reality interface presented in conjunction with the captured images).

In some embodiments, additionally or alternatively, the external device can automatically detect and/or determine the distribution of audio system modules. For example, if the external device is equipped with an image capture device (e.g., a camera), an application executing on the external device could capture one or more images of the space, recognize audio system modules in the image(s), and determine a layout of the space and locations of the audio system modules within the space based on the image(s). In some other embodiments, from a stationary location in the space (e.g., approximately in the center of the room), computing device 170 can emit a test signal (e.g., a sound in a human-inaudible frequency) to the audio system modules in the space. The audio system modules in the space can detect the test signal via a microphone of input devices 114. Additionally and/or alternatively, computing device 170 may transmit the test signal and/or a test command to the audio system modules in the space via a wireless and/or other type of connection. Each audio system module in the space, one at a time, can emit a response signal (e.g., another sound in a human-inaudible frequency, a light from an indicator light) in response to the test signal. Computing device 170 can, based on the response signals, determine locations of the audio system modules (e.g., based on sound triangulation and/or mapping of response lights) and accordingly determine a distribution layout and network map of the audio system modules.

Figure 7:
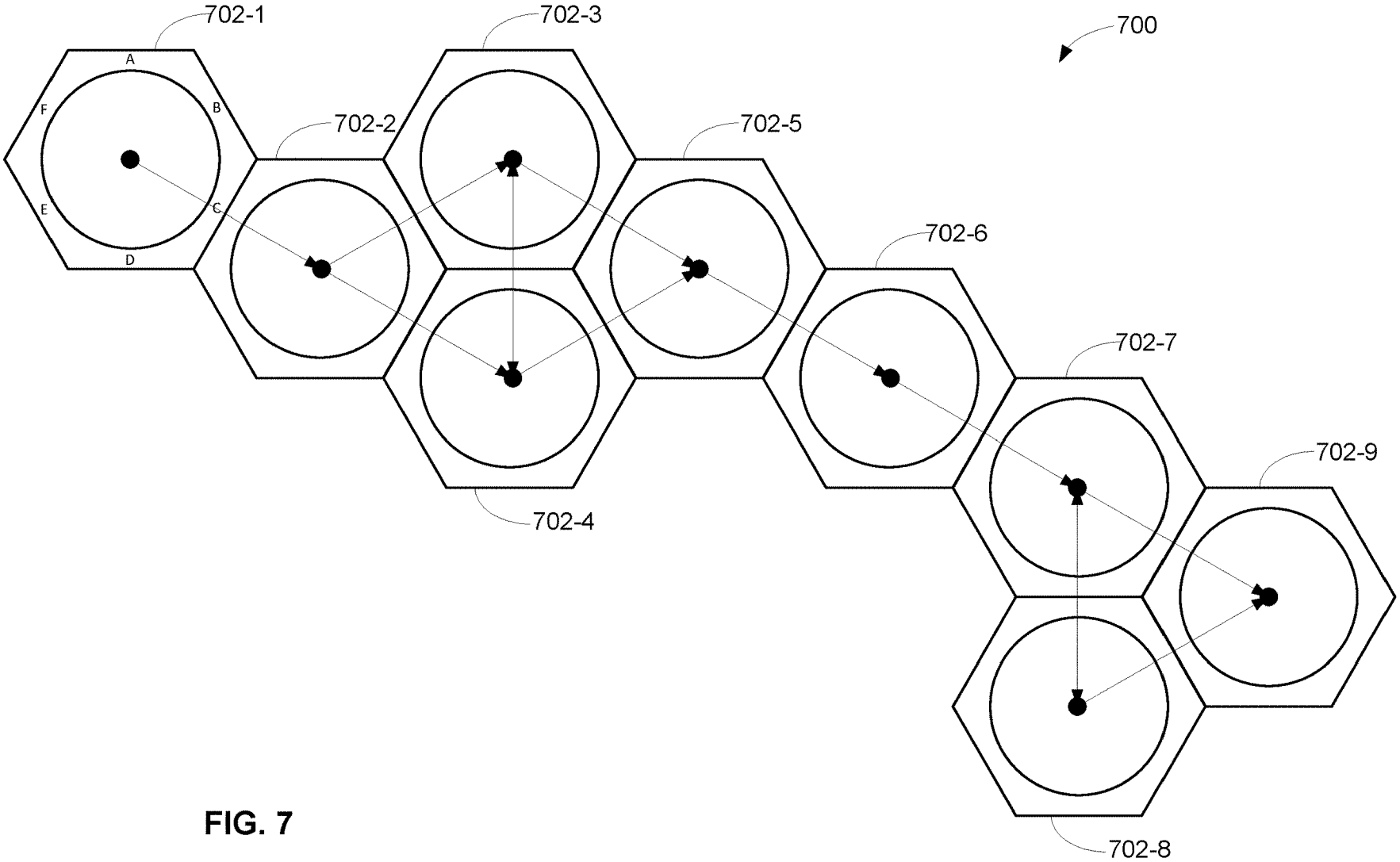
FIG. 7 illustrates an example network map of an array of physically connected audio system modules, according to various embodiments.

FIG. 7 illustrates an example network map of an array of physically connected audio system modules, according to various embodiments. In various embodiments, a set of physically connected audio system modules can self-map the network of the physically connected audio system modules. By mapping the network of the physically connected modules, the modules can synchronize and manipulate audio output by the physically connected modules based on the network. The network can be represented as a graph where each of the physically connected audio system modules is a node and each physical connection is an edge.

As shown in FIG. 7, a network 700 of physically connected audio system modules 702 includes audio system modules 702-1 thru 702-9 physically connected via connectors (e.g., connectors 208) on their side walls. Each audio system module 702 as shown is hexagonal and accordingly has six side walls, each side wall having a set of connectors for connecting with another audio system module 702. Accordingly, a given audio system module 702 can directly physically connect with up to six other audio system modules 702. A given audio system module 702 can map at least a portion of network 700 by detecting any audio system modules 702 that are physically connected to audio system module 702 and determining the side walls(s) to which those modules are connected. For example, starting from one end of network 700, audio system module 702-1 would detect that module 702-2 is physically connected via the side wall labeled in FIG. 7 as "C." Similarly, module 702-2 would detect that modules 702-1, 702-3, and 702-4 are physically connected via respective side walls of module 702-2, and so on until the set of physically connected audio system modules 702 are traversed. Based on these detections and determinations, set of physically connected audio system modules 702 can determine a map of network 700, represented in FIG. 7 by the directed arrows. The set of physically connected audio system modules 702 can self-map network 700 using any technically feasible technique, examples of which include, without limitation, wireless tagging, ZigBee network mapping, current sensing, digital addressing, and/or the like. One or more of audio system modules 702 can transmit the map of network 700 to a computing device (e.g., computing device 170).

In some embodiments, the set of physically connected audio system modules 702 can also exchange identifying information, including functionality information. An audio system module 702 can transmit identification information to a physically connected module, where the identification information can include an identifier of audio system module 702 and information indicating a functionality or role of audio system module 702 (e.g., whether audio system module 702 is a full-range speaker module, a subwoofer module, a control module, etc.).

In some embodiments, the set of physically connected audio system modules 702 can determine one module amongst the set to be a coordinator/routing module for the set. The coordinator/routing module is responsible for communicating with other, wirelessly communicatively coupled audio system modules and/or a paired device (e.g., computing device 170). For example, the coordinator/routing module can report information indicating the map of network 700 to a wirelessly coupled audio system modules and/or a computing device 170, receive audio and/or control signals from the wirelessly coupled audio system modules and/or a computing device 170, and/or transmit the audio and/or control signals to other physically connected audio system modules 702 in network 700. The set of physically connected audio system modules 702 can automatically determine a coordinator/routing module using any technically feasible technique.

In various embodiments, audio system modules of an audio system, distributed across a space, can be communicatively coupled with each other and/or a paired device (e.g., computing device 170). Thus, for example, the audio system modules distributed across space 500 above can be communicatively coupled to each other and/or a computing device 170. For example, as described above with reference to FIG. 7, the coordinator/router module within a set of physically connected audio system modules can communicate with other audio system modules and/or computing device 170. A single module, not physically connected with any other module, can also be communicatively coupled to other modules and/or computing device 170. Further, in some embodiments, amongst the coordinator/router modules and single modules in the audio system, one of these can be specified or configured to be the master coordinator/routing module for the audio system as a whole. The master coordinator/routing module is responsible for receiving audio signals and optionally control signals (e.g., from a directly connected audio source, from computing device 170) and distribute those signals to the other coordinator/routing modules and single modules within the audio system. The master coordinator/routing module can be determined using any technically feasible technique.

In various embodiments, operation of an audio system module in an audio system can be controlled based on its position in a set of physically connected modules and/or its position in the audio system module as a whole. For example, each of audio system modules shown in FIG. 5 can operate according to its respective position in space 500. Set 508 of audio system modules 508 can operate as a center speaker of a surround system. Audio system modules 504 and 506 can operate as left and right front speakers, respectively. Sets 510 and 512 of audio systems modules can operate as left and right rear or side speakers, respectively. Example of audio system module operations that can depend on position include, for example and without limitation, phased array operation, audio output beamforming, and surround sound effects. A module can be configured to operate in a certain mode (e.g., in a center, front, or rear speaker mode within a surround system), with certain parameters (e.g., a degree and/or amount of beam forming), and/or with certain attributes via control signals. The control signals can be generated by computing device 170, a master coordinator/routing module, and/or a coordinator/routing module within a set of physically connected modules based to the positions of the modules. In some embodiments, an audio system module can self-determine its mode, parameter(s), and/or attribute(s) of operation based on its position. In some embodiments, computing device 170 can generate a map of positions of audio system modules in the audio system (e.g., based on user input and/or automatic detection as described above with reference to FIG. 6) and distribute information indicating the map to the audio system modules via a master coordinator/routing module.

While the present disclosure describes various embodiments in which multiple audio system modules operate together, it should be appreciated that a single audio system module (e.g., audio system module 100) can operate alone or independently (e.g., as a single speaker). For example, a user could carry around a single audio system module and use that as a portable speaker. As another example, each of multiple audio system modules in a space can operate as speakers independently of each other. A location of a single speaker can be positioned in a space and located in the space via a paired device, similar to the embodiments described with reference to FIGS. 5-6 above.

Figure 8:
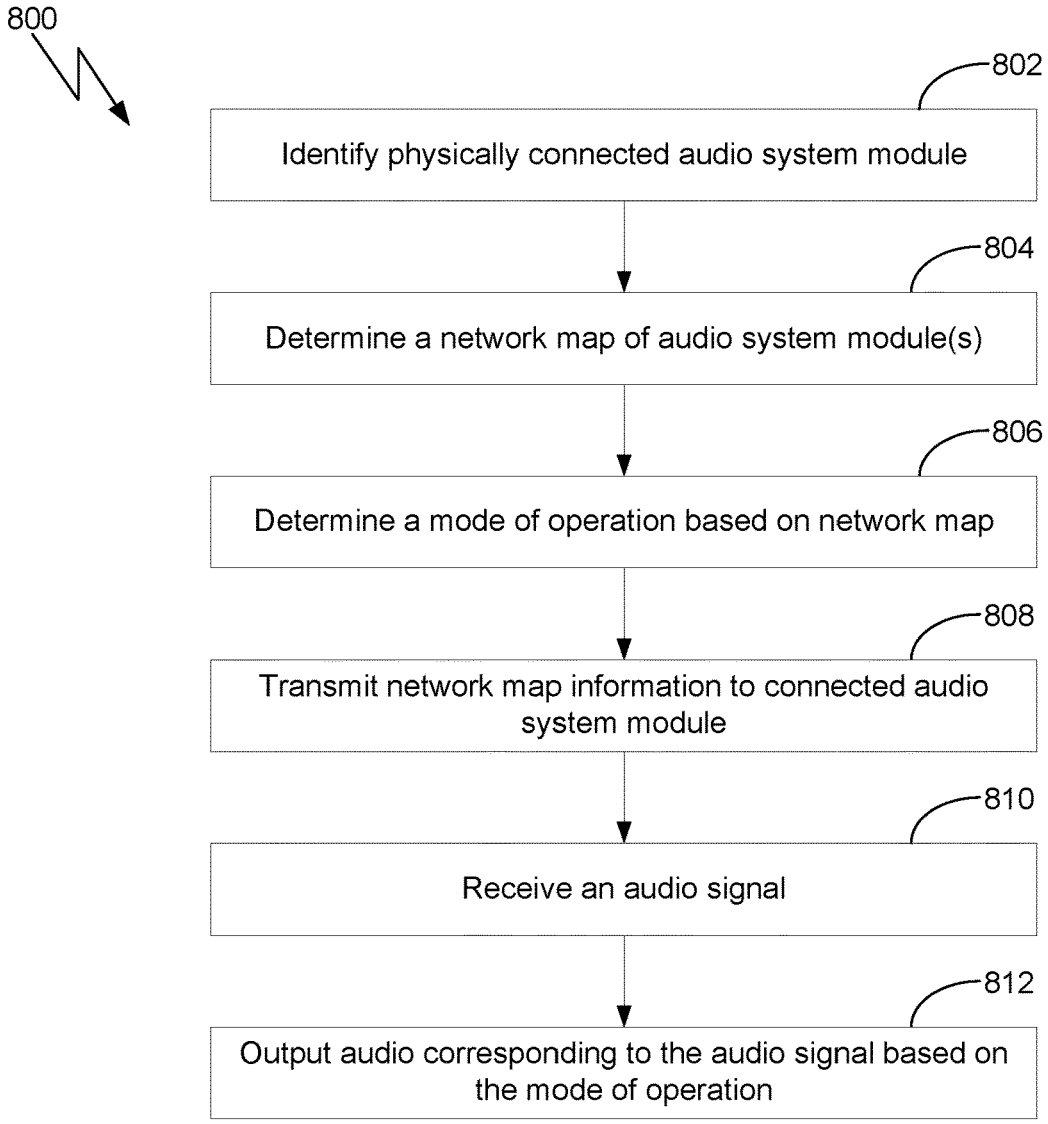
FIG. 8 illustrates a flow diagram of method steps for outputting audio according to a network map of audio system modules, according to various embodiments.

FIG. 8 illustrates a flow diagram of method steps for outputting audio according to a network map of audio system modules, according to various embodiments. Although the method steps are described with respect to the systems of FIGS. 1-7, persons skilled in the art will understand that any system configured to perform the method steps, in any order, falls within the scope of the various embodiments.

As shown, method 800 begins at step 802, where an audio system module identifies one or more physically connected audio system modules. An audio system module can detect any other audio system modules directly physically connected to the audio system module and to identify those modules. For example, in FIG. 7 audio system module 702-1 can detect and identify physically connected module 702-2. Similarly, module 702-2 can detect and identify physically connected audio system modules 702-1, 702-3, and 702-4. In some embodiments, the identifying includes identifying a functionality or role of a module (e.g., is a module a full-range speaker, a subwoofer, a control module, etc.).

At step 804, the audio system module determines a map of audio system modules. Based on the identification of physically connected audio system modules, an audio system module can determine and/or generate at least a partial network map of physically connected modules. For example, audio system module 702-1 can determine a network map that includes at least audio system modules 702-1 and 702-2. Audio system module 702-2 can determine a network that includes at least audio system modules 702-1 thru 702-4.

At step 806, the audio system module determines a mode of operation based on the network map. A module can determine, based on its position in the network map and the functionalities/roles of other modules in the network map, its mode of operation, including but not limited to a mode (e.g., as a subwoofer, as a full-range speaker, as a front speaker in a surround system, as a speaker in a sound bar, etc.), one or more parameters, and/or one or more attributes.

At step 808, the audio system module transmits network map information to a physically connected audio system module. An audio system module can transmit its network map determined in step 804 to a physically connected audio system module. Accordingly, the audio system modules can pass on network map information amongst each other, and each of the modules can get a fuller picture of the network map as a whole. In some embodiments, step 806 (determining a mode of operation) can be performed after network map information is passed around the set of physically connected audio system modules and each of the set of physically connected audio system modules has a full picture of the network map (e.g., each of physically connected audio system modules 702 has the full network map of network 700).

At step 810, the audio system module receives an audio signal. The audio system module can receive audio signals from a communicatively coupled (e.g., physically or wirelessly connected) audio system module or from a paired device (e.g., computing device 170).

At step 812, the audio system module outputs audio corresponding to the audio signal based on the mode of operation. The audio system module generates and outputs audible sounds corresponding to the audio signal according to the mode, parameter(s), and/or attributes determined in step 806. For example, an audio system module configured to beam-form audio can output sounds that correspond to beamforming of the audio signal. The audio system module can perform any technically suitable processing of the audio signal to output sounds according to the determined mode, parameter(s), and/or attributes (e.g., beamforming, surround effects, frequency filtering, etc.).

Figure 9:
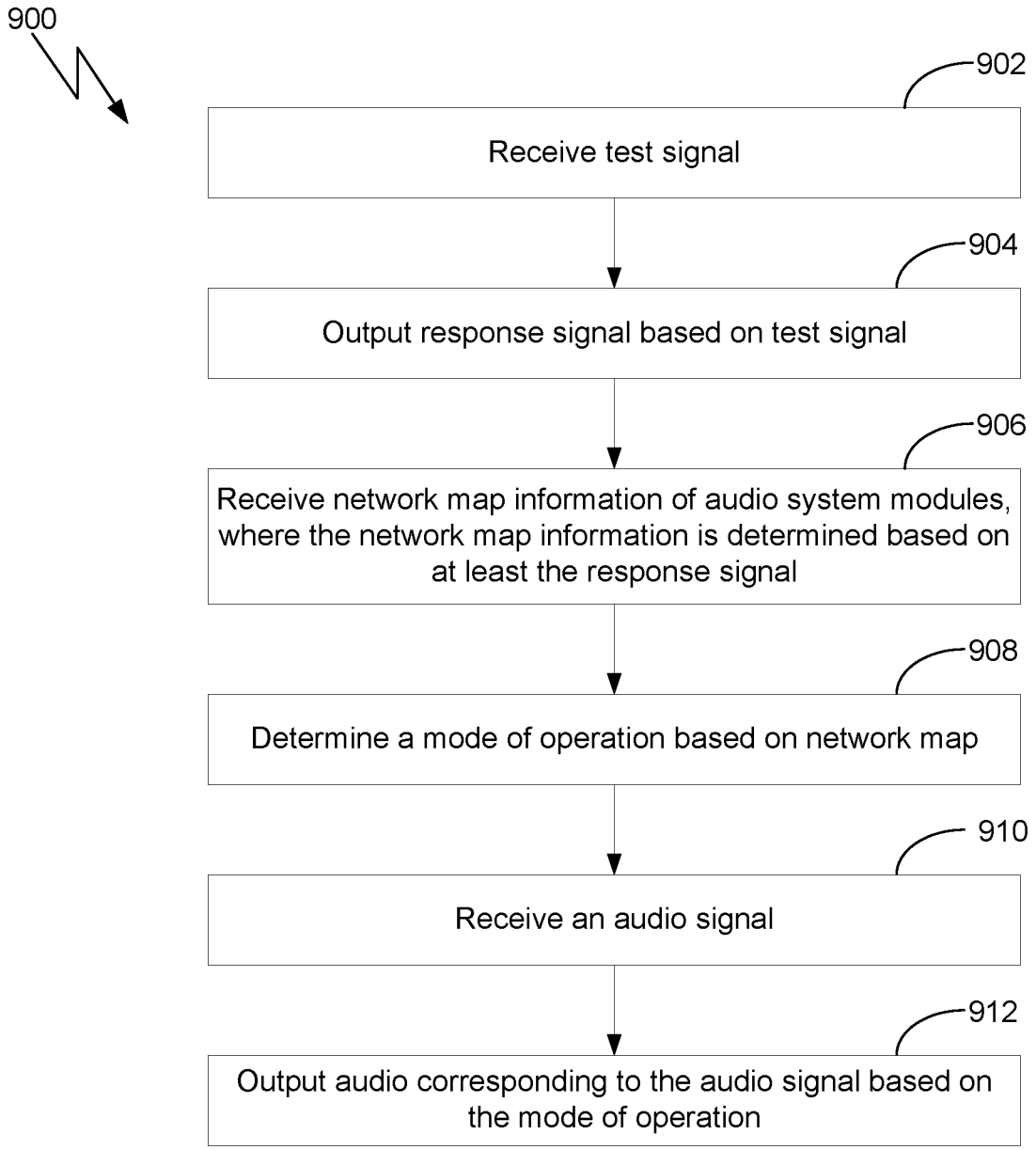
FIG. 9 illustrates another flow diagram of method steps for outputting audio according to a network map of audio system modules, where the network map is generated based on a test signal, according to various embodiments.

FIG. 9 illustrates another flow diagram of method steps for outputting audio according to a network map of audio system modules, where the network map is generated based on a test signal, according to various embodiments. Although the method steps are described with respect to the systems of FIGS. 1-7, persons skilled in the art will understand that any system configured to perform the method steps, in any order, falls within the scope of the various embodiments.

As shown, method 900 begins at step 902, where an audio system module receives a test signal. A computing device 170 can emit a test signal to elicit a response from the audio system module for purposes of determining a position of the audio system module in a space and relative to other audio system modules in the space.

At step 904, the audio system module outputs a response signal based on the test signal. In response to the test signal, the audio system module can output a response sound and/or light, which can be detected by computing device 170.

At step 906, the audio system module receives network map information of audio system modules, where the network map is determined based on at least the response signal. Computing device 170 can determine and/or generate a network map of audio system modules based on the response sounds/lights from the audio system module and other audio system modules, output in accordance with step 904 above. Computing device 170 can then propagate information indicating the network map to the audio system module (e.g., via one or more modules communicatively coupled to computing device 170).

At step 908, the audio system module determines a mode of operation based on the network map. A module can determine, based on its position in the network map (as indicated in the network map information) and the functionalities/roles of other modules in the network map, its mode of operation, including but not limited to a mode (e.g., as a subwoofer, as a full-range speaker, as a front speaker in a surround system, as a speaker in a sound bar, etc.), one or more parameters, and/or one or more attributes.

At step 910, the audio system module receives an audio signal. The audio system module can receive audio signals from a communicatively coupled (e.g., physically or wirelessly connected) audio system module or from a paired device (e.g., computing device 170).

At step 912, the audio system module outputs audio corresponding to the audio signal based on the mode of operation. The audio system module generates and outputs audible sounds corresponding to the audio signal according to the mode, parameter(s), and/or attributes determined in step 908. For example, an audio system module configured to beam-form audio can output sounds that correspond to beamforming of the audio signal. The audio system module can perform any technically suitable processing of the audio signal to output sounds according to the determined mode, parameter(s), and/or attributes (e.g., beamforming, surround effects, frequency filtering, etc.).

In sum, an audio system includes one or more various audio system modules, or "cells," that can be arranged and/or coupled together in various combinations. An audio system module can operate singly or in combination with other audio system modules. In some embodiments, the audio system can include cells for speaker/transducer functionality, subwoofer functionality, source input functionality, user interface functionality, power functionality, etc. The audio system can be operated and/or configured with or without the aid of an application running on a computing device paired with the audio system. Audio system modules can couple with each other wirelessly and/or via a physical connection. When multiple audio system modules are coupled physically into a group, the modules within the group can self-map the network of modules within the group and the respective locations of the modules within the network. Based on the mapping of the network of modules, the audio system can control the capabilities of individual modules within the network.

An advantage and technical improvement of the disclosed embodiments relative to the prior art is that an audio system module is portable and can be flexibly arranged and combined in conjunction with additional audio system modules. Accordingly, an audio system composed of such modules can be deployed and configured physically and acoustically for different use cases. Such an audio system can also be easily positioned and scaled to various form factors, sizes, and functionalities and/or capabilities based on the use case. Such an audio system can also be easily repositioned and/or reconfigured compared to conventional speaker systems. Furthermore, a set of audio system modules can be physically connected into a network of modules and self-map the network of modules. The capability of a module within the network can be controlled according to its location within the network. These technical advantages provide one or more technological improvements over prior art approaches.

1. In some embodiments, a system comprises a first audio system module comprising a speaker, a connector, and one or more processing units, wherein the one or more processing units are configured to detect a second audio system module connected to the connector; determine a network map of audio system modules, wherein the network map comprises at least the first audio system module and the second audio system module; determine a mode of operation based on the network map; receive an audio signal; and via the speaker, output audio corresponding to the audio signal based on the mode of operation.

2. The system of clause 1, wherein the one or more processing units are further configured to transmit the network map to the second audio system module or a computing device.

3. The system of clauses 1 or 2, wherein the mode of operation comprises at least one of a parameter of operation or an attribute of operation.

4. The system of any of clauses 1-3, wherein the connector is a magnetic connector, and the connector is connected to a second connector of the second audio system module.

5. The system of any of clauses 1-4, wherein the one or more processing units are further configured to receive network map information from the second audio system module.

6. The system of any of clauses 1-5, wherein the one or more processing units are further configured to receive one or more control signals; and determine the mode of operation based on the one or more control signals.

7. The system of any of clauses 1-6, wherein the one or more processing units are further configured to receive one or more control signals; and transmit the one or more control signals to the second audio system module.

8. The system of any of clauses 1-7, wherein the audio signal is received from the second audio system module.

9. The system of any of clauses 1-8, wherein the audio signal is received from a third audio system module wirelessly and communicatively coupled to the first audio system module.

10. The system of any of clauses 1-9, wherein the audio signal is received from a computing device communicatively coupled to the first audio system module.

11. The system of any of clauses 1-10, wherein the first audio system module is one of a full-range speaker module, a subwoofer module, a display module, an audio source module, a control module, a power module, or a wireless connection module.

12. In some embodiments, a method for outputting audio at an audio system module comprises detecting a second audio system module connected to the audio system module via a physical connection; determining a network map of audio system modules, wherein the network map comprises at least the audio system module and the second audio system module; determining a mode of operation based on the network map; receiving an audio signal; and outputting audio corresponding to the audio signal based on the mode of operation.

13. The method of clause 12, further comprising transmitting the network map to the second audio system module or a computing device.

14. The method of clauses 12 or 13, further comprising receiving the audio signal wirelessly from a computing device.

15. The method of any of clauses 12-14, further comprising receiving the audio signal from the second audio system module.

16. The method of any of clauses 12-15, further comprising transmitting the audio signal to the second audio system module via the physical connection.

17. In some embodiments, one or more non-transitory computer-readable storage media include instructions that, when executed by one or more processors, cause the one or more processors to perform the steps of, at an audio system module, receiving a test signal; in response to the test signal, outputting a response signal; receiving network map information indicating a network map of audio system modules, wherein the network map is determined based on at least the response signal; determining a mode of operation based on the network map; receiving an audio signal; and outputting audio corresponding to the audio signal based on the mode of operation.

18. The one or more non-transitory computer-readable storage media of clause 17, wherein the audio system module is connected to a second audio system module via a physical connection, and the network map includes the audio system module and the second audio system module.

19. The one or more non-transitory computer-readable storage media of clauses 17 or 18, wherein the network map is determined based further on a second response signal output by the second audio system module.

20. The one or more non-transitory computer-readable storage media of any of clauses 17-19, wherein the test signal is received from a computing device.

Any and all combinations of any of the claim elements recited in any of the claims and/or any elements described in this application, in any fashion, fall within the contemplated scope of the present disclosure and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module," a "system," or a "computer." In addition, any hardware and/or software technique, process, function, component, engine, module, or system described in the present disclosure may be implemented as a circuit or set of circuits. Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A system, comprising:

a first audio system module comprising:

a speaker;

one or more connectors; and one or more processing units, wherein the one or more processing units are configured to:

detect one or more direct physical connections between the first audio system module and one or more additional audio system modules;

determine, based on the one or more direct physical connections, a network map of physically connected audio system modules, wherein the network map comprises a graph describing the physically connected audio system modules and physical connections between the physically connected audio system modules, the graph describing at least the physical connections between the first audio system module and the one or more additional audio system modules;

determine a mode of operation based on the network map;

receive an audio signal; and via the speaker, output audio corresponding to the audio signal based on the mode of operation.

2. The system of claim 1, wherein the one or more processing units are further configured to transmit the network map to a second audio system module in the one or more additional audio system modules, or a computing device.

3. The system of claim 1, wherein the mode of operation comprises at least one of a parameter of operation or an attribute of operation.

4. The system of claim 1, wherein one of the one or more direct physical connections includes a magnetic connector that is connected to a connector of a second audio system module in the one or more additional audio system modules.

5. The system of claim 1, wherein the one or more processing units are further configured to receive network map information from a second audio system module in the one or more additional audio system modules.

6. The system of claim 1, wherein the one or more processing units are further configured to:

receive one or more control signals; and determine the mode of operation based on the one or more control signals.

7. The system of claim 1, wherein the one or more processing units are further configured to:

receive one or more control signals; and transmit the one or more control signals to a second audio system module in the one or more additional audio system modules.

8. The system of claim 1, wherein the audio signal is received from a second audio system module in the one or more additional audio system modules.

9. The system of claim 1, wherein the audio signal is received from a second audio system module, wherein:

the first audio system module does not include a direct physical connection to the second audio system module; and the second audio system module is wirelessly coupled to the first audio system module.

10. The system of claim 1, wherein the audio signal is received from a computing device communicatively coupled to the first audio system module.

11. The system of claim 1, wherein the first audio system module is one of a full-range speaker module, a subwoofer module, a display module, an audio source module, a control module, a power module, or a wireless connection module.

12. A method for outputting audio at an audio system module, comprising:

detecting, by an audio system module, one or more direct physical connections between the audio system module and one or more additional audio system modules;

determining, based on the one or more direct physical connections, a network map of physically connected audio system modules, wherein the network map comprises a graph describing physically connected audio system modules and physical connections between the physically connected audio system modules, the graph describing at least the physical connections between the audio system module and the one or more additional audio system modules;

determining a mode of operation based on the network map;

receiving an audio signal; and outputting audio corresponding to the audio signal based on the mode of operation.

13. The method of claim 12, further comprising transmitting the network map to a second audio system module in the one or more additional audio system modules, or a computing device.

14. The method of claim 12, further comprising receiving the audio signal wirelessly from a computing device.

15. The method of claim 12, further comprising receiving the audio signal from a second audio system module in the one or more additional audio system modules.

16. The method of claim 12, further comprising transmitting the audio signal to a second audio system module in the one or more additional audio system modules via a first direct physical connection in the one or more direct physical connections.

17. One or more non-transitory computer-readable storage media including instructions that, when executed by one or more processors of a first audio system module, cause the one or more processors to perform the steps of:

receiving network map information via a direct physical connection from a second audio system module, the network map information indicating a network map comprising a graph describing an array of physically connected audio system modules and physical connections between the physically connected audio system modules, wherein the second audio system module is in the array of physically connected audio system modules;

detecting one or more direct physical connections to one or more additional audio system modules to the first audio system module;

updating, based on the one or more direct physical connections, the graph to include a description of the at least one or mode additional audio system modules and detected one or more direct physical connections;

determining a mode of operation based on the network map information;

receiving an audio signal; and outputting audio corresponding to the audio signal based on the mode of operation.

18. The one or more non-transitory computer-readable storage media of claim 17, wherein the network map information includes the first audio system module and the second audio system module.

19. The one or more non-transitory computer-readable storage media of claim 18, the steps further comprising:

receiving second network map information from a third audio system module, wherein the third audio system module is wirelessly coupled to the first audio system module, and wherein the network map information is further updated with the second network map information.

20. The one or more non-transitory computer-readable storage media of claim 17, wherein the audio signal is received from a computing device.

* * * * *